US005495699A

United States Patent [19]

Buckley, Jr.

[11] Patent Number: 5,495,699

[45] Date of Patent: Mar. 5, 1996

[54] METHOD AND APPARATUS FOR PRESSURE FILLING AND SEALING A VESSEL

[75] Inventor: Thomas I. Buckley, Jr., Stevensville, Mich.

[73] Assignee: Weldun International, Inc., Bridgman, Mich.

[21] Appl. No.: 336,764

[22] Filed: Nov. 9, 1994

[51] Int. Cl.[6] ..... B65B 31/02; B65B 7/28

[52] U.S. Cl. ..... 53/81; 53/88; 53/98; 53/329.2

[58] Field of Search ..... 53/80, 81, 84, 53/98, 404, 88, 89, 94, 97, 98, 329.2; 73/11.04

[56] References Cited

U.S. PATENT DOCUMENTS

| | | | |
|---|---|---|---|
| 619,681 | 2/1899 | Dorsey | 53/80 |
| 3,057,131 | 10/1962 | McKinley et al. | 53/88 |
| 3,212,228 | 10/1965 | Merz | 53/88 |
| 3,247,640 | 4/1966 | Miles et al. | 53/404 X |
| 3,577,696 | 5/1971 | Bock et al. | 53/97 X |
| 3,983,678 | 10/1976 | Bogler et al. | 53/88 X |
| 4,255,916 | 3/1981 | Blankenship et al. | 53/88 X |
| 4,439,976 | 4/1984 | Yuji et al. | 53/97 X |
| 4,458,734 | 7/1984 | Scholle et al. | 53/88 X |
| 4,712,353 | 12/1987 | Bethell et al. | 53/80 |

*Primary Examiner*—Horace M. Culver
*Attorney, Agent, or Firm*—Baker & Daniels

[57] ABSTRACT

The invention is directed to an apparatus for filling and sealing a canister having a weldable end wall. A weld head assembly includes a head having a welding electrode disposed within an opening for receiving a pressurized gas and defining a terminal end. The head further has a seal operably associated with the terminal end for engaging the end wall of the canister. A ball shuttle assembly includes a shuttle block having a passage for receiving the weld ball. The ball shuttle assembly further includes a device for positioning the shuttle block whereby the weld ball is in substantially coaxial alignment with the opening, and moving the weld ball into the opening of the weld head. The passage of the shuttle block is fluidly disassociated from the opening in the weld head when the seal is engaged with the end wall of the canister. The present invention further is directed to an apparatus for pressure testing a weldable vessel, which properly aligns a top flange of the vessel with an end face of the apparatus to thereby ensure proper sealing therebetween during the pressure testing operation.

20 Claims, 6 Drawing Sheets

METHOD AND APPARATUS FOR PRESSURE FILLING AND SEALING A VESSEL

BACKGROUND OF THE INVENTION

1. Field of the Invention

The present invention relates to an apparatus for filling a vessel with high pressure gas and thereafter sealing the vessel, and more particularly, relates to an apparatus for filling an air bag canister with high pressure gas and sealing the end wall of the canister.

2. Description of the Related Art

An apparatus for supplying gas under high pressure to a weldable air bag canister and thereafter sealing the air bag canister are known in the art. Such known apparatus includes a gas fill and weld head assembly having a weld head with a primary bore therein, in which a welding electrode is disposed. A weld ball feed system includes a plurality of pistons slidably disposed in a plurality of respective passageways. By controlling the sliding movement of the pistons, individual weld balls may be supplied to the primary bore from an external feed source. A problem with such an apparatus, however, is that the weld ball feed system is exposed to the high pressure of the gas when the air bag canister is filled. Consequently, a plurality of seals must be used between the reciprocating pistons and the passageways to prevent gas leakage to the outside ambient environment. Such seals may fail over a period of time and thereby allow escape of the gas to the outside ambient environment, which is not desirable.

Another problem with such conventional designs is that each separate piston requires a separate drive mechanism for reciprocating the piston within the respective passageway. The multiplicity of such required drives increases the complexity and cost of the system, as well as adding another possible source of failure.

What is needed in the art is an apparatus for filling and sealing a weldable vessel which can supply weld balls to a weld head assembly while being fluidly disassociated from the weld head assembly. Such an apparatus would accordingly not require the plurality of seals used in known apparatus, and thereby avoid disadvantages associated therewith.

SUMMARY OF THE INVENTION

The present invention provides an apparatus for filling and sealing a weldable vessel, including a weld ball delivery system which is fluidly disassociated from a weld head assembly. A ball shuttle assembly may be moved to a first position under the weld head for supplying a weld ball to the weld head assembly, and a second position whereby no portion of the ball shuttle assembly is disposed below the weld head of the weld head assembly. The present invention further provides an apparatus for pressure testing a weldable vessel, which properly aligns a top flange of the vessel with an end face of the apparatus to thereby ensure proper sealing therebetween during the pressure testing operation.

The invention comprises, in one form thereof, an apparatus for filling a canister having a weldable end wall and an opening therein with pressurized fluid, and sealing the filled canister. A weld head assembly includes a head having an opening for receiving a pressurized gas and defining a terminal end. The head further has a seal operably associated with the terminal end for engaging the end wall of the canister. The weld head assembly further includes a welding electrode reciprocably disposed in the elongated opening. A ball shuttle assembly includes a shuttle block having a passage for receiving the weld ball and a device for receiving and holding the weld ball. The ball shuttle assembly further includes a device for positioning the shuttle block whereby the weld ball is in substantially coaxial alignment with the opening, and a device for moving the receiving and holding device whereby the weld ball is disposed in the opening. The passage of the shuttle block is fluidly disassociated from the opening in the weld head when the seal is engaged with the end wall of the canister.

An advantage of the present invention is that the ball shuttle assembly is fluidly disassociated with the gas fill and weld assembly.

Another advantage of the present invention is that the weld ball feed system, i.e., the ball shuttle assembly, does not require any seals.

A further advantage is that the top flange of the air bag canister may be aligned with the end face of a proofing station to effect an adequate seal therebetween, and thus prevent leakage of gas to the outside ambient environment under a high pressure test.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
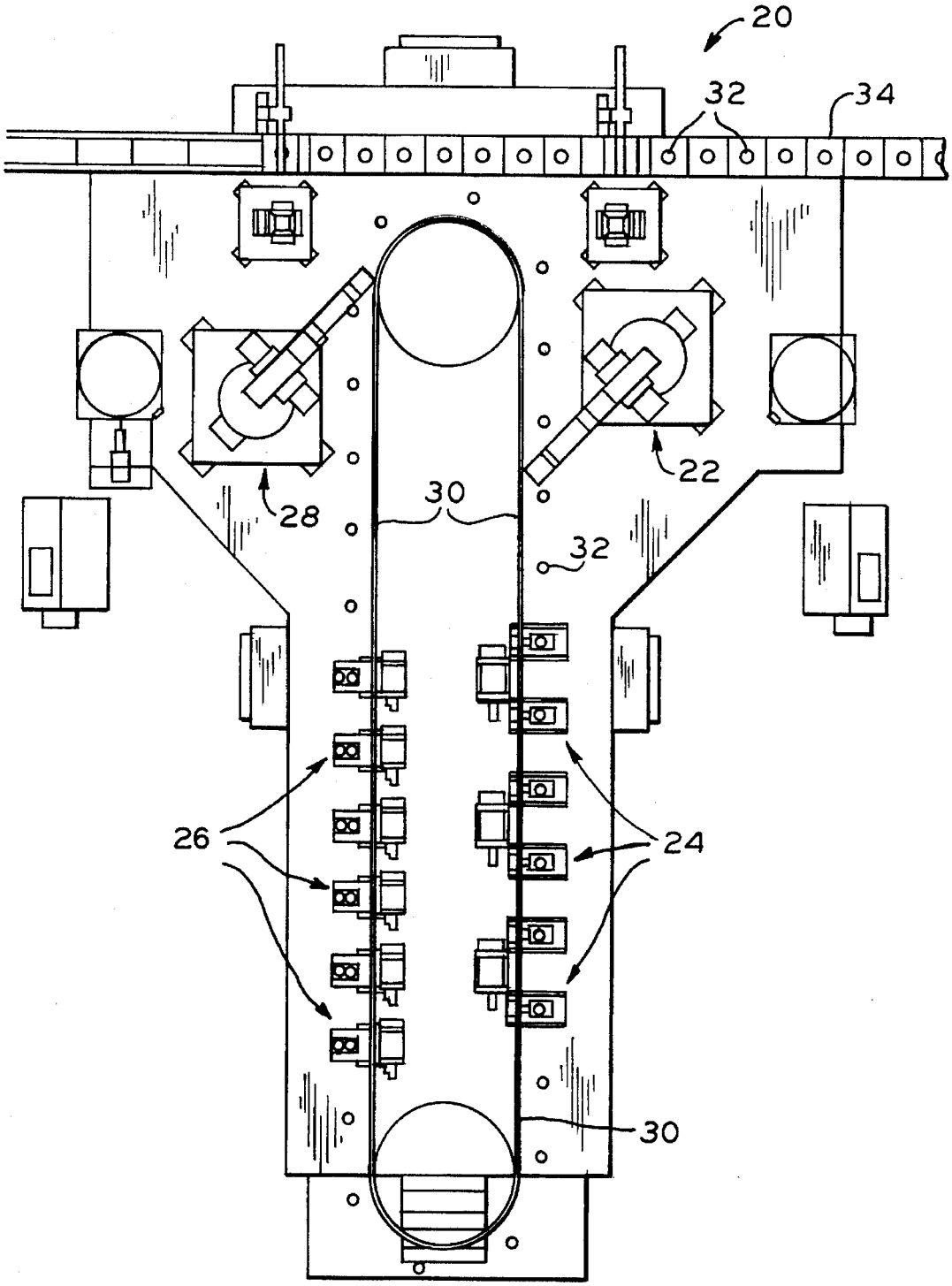
FIG. 1 is a schematic illustration of an embodiment of a system of the present invention.

Referring now to the drawings, and more particularly to FIG. 1, there is shown an embodiment of a system 20 of the present invention, including a loading station 22, proofing station 24, gas fill and weld station 26, and unloading station 28. An offline precision link assembly 30 interconnects stations 22, 24, 26 and 28 and carries a plurality of vessels, such as gas bag canisters, from one station to another.

Loading station 22 removes canisters 32 from transport system 34, such as a conveyor, and places canisters 32 on offline precision link assembly 30. Offline precision link assembly 30 moves canisters 32 to each of proofing station 24 and gas fill and weld station 26. Unloading station 28 removes canisters 32 from offline precision link assembly 30 and places canisters 32 back onto conveyor 34. In the embodiment shown, each of loading station 22 and unloading station 28 is a controllable robot with a pivotable arm.

Figure 2:
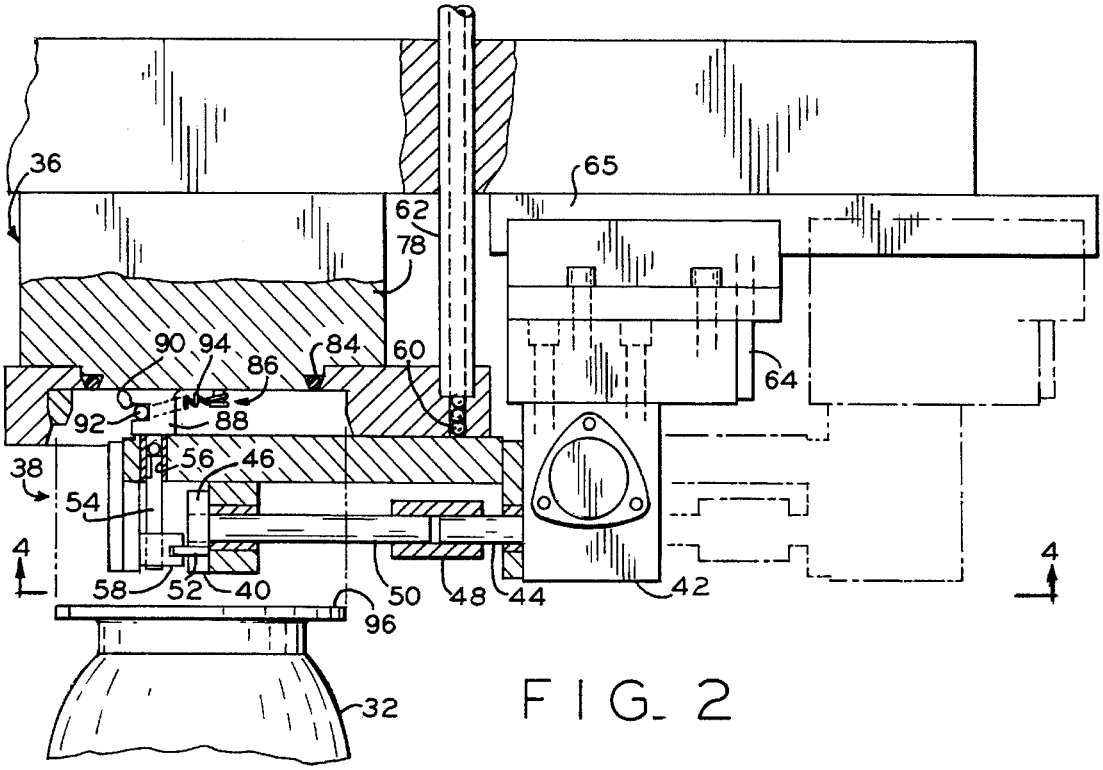
FIG. 2 is a schematic side view of an embodiment of a weld head assembly and ball shuttle assembly of the present invention.
Figure 3:
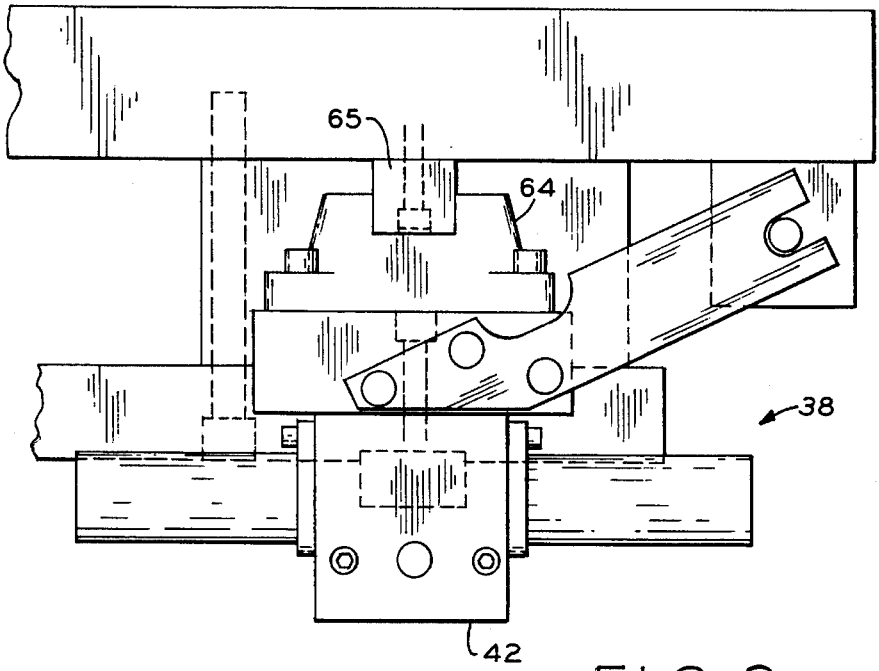
FIG. 3 is an end view of the ball shuttle assembly shown in FIG. 2.
Figure 4:
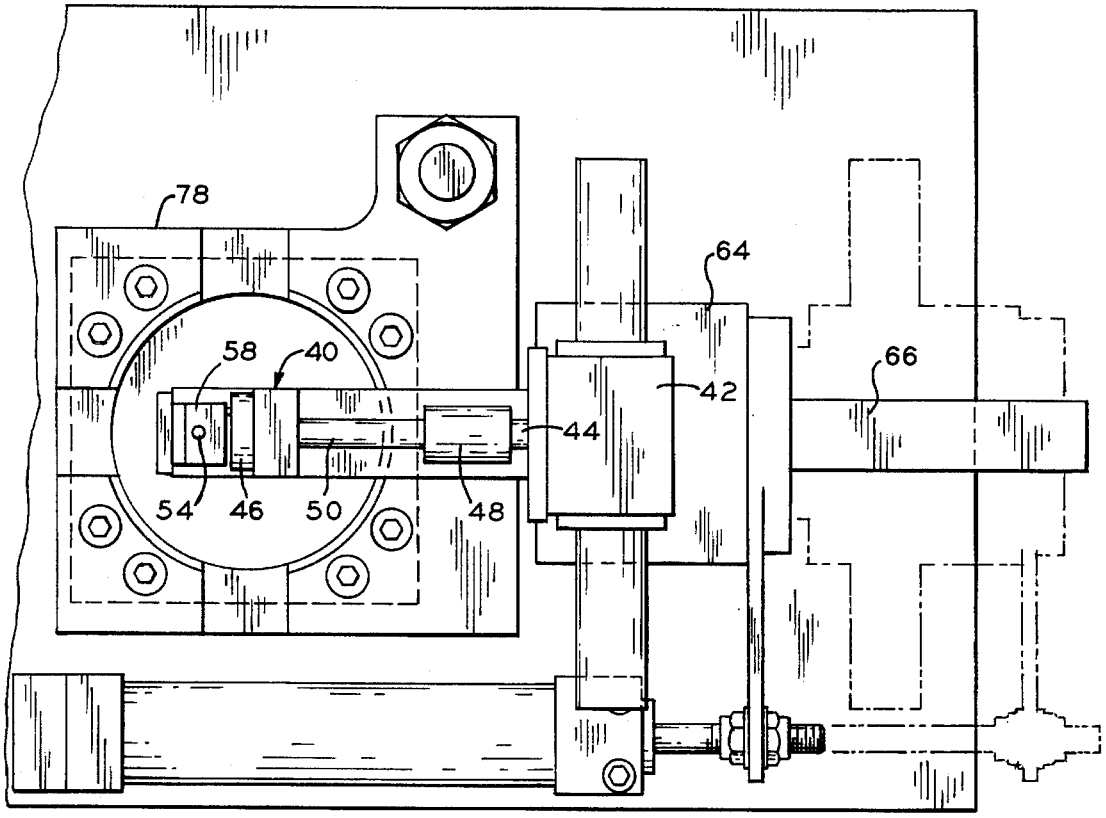
FIG. 4 is a sectional view of the weld head assembly and ball shuttle assembly, taken along line 4—4 in FIG. 2.
Figure 5:
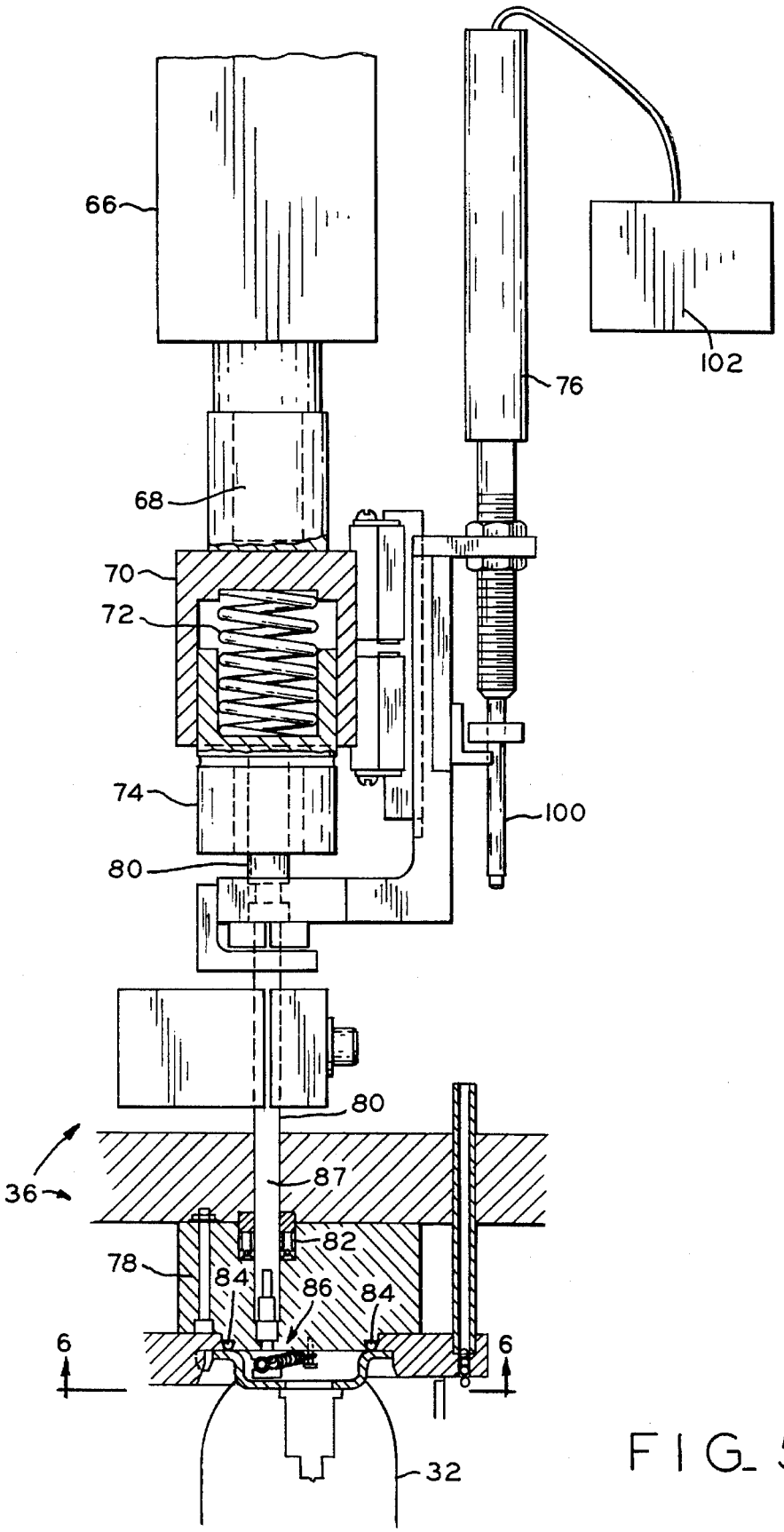
FIG. 5 is a side sectional view of the: weld head assembly shown in FIG. 2.

Referring now to FIGS. 2–6, gas fill and weld station 26 is shown in greater detail. In the embodiment shown in the drawings, six such stations are utilized (FIG. 1). Gas fill and weld station 26 includes a weld head assembly 36 and a ball shuttle assembly 38. FIG. 2 illustrates ball shuttle assembly 38 in an extended position for supplying a weld ball to weld head assembly 36; and FIG. 5 illustrates weld head assembly 36 in sealing engagement with a canister 32, such as an air bag canister.

Ball shuttle assembly 38 (FIG. 2) is movable between a first, extended position (shown in solid lines) for supplying a weld ball to weld head assembly 36; and a second, retracted position (shown in phantom lines) which occurs when weld head assembly 36 is in contact with canister 32. Ball shuttle assembly 38 includes a shuttle block 40 which is connected to a rotary actuator 42. More particularly, rotary actuator 42 is connected to and drivingly rotates a first shaft 44, which in turn is connected to a cam 46 via a coupling 48 and second shaft 50. Cam 46 includes an extension 52 which drives a rod 54 in an axial direction. Rod 54 is slidably disposed within a bore 56 formed in shuttle block 40. Rod 54 includes a collar 58 having a recess (not numbered) therein for receiving extension 52. As rotary actuator 42 rotates each of first shaft 44, coupling 48, second shaft 50 and cam 46, rod 54 is moved in an axial direction within bore 56. Shuttle block 40 receives a weld ball 60 within bore 56 when ball shuttle assembly 38 is moved to the second, retracted position, as shown in phantom lines. Weld balls 60 are supplied to bore 56 via a gravity feed tube 62. To effect the movement of shuttle block assembly 38 between the first, extended position and second, retracted position, ball shuttle assembly 38 includes a support housing 64 which is slidably attached to a rail 65.

Figure 6:
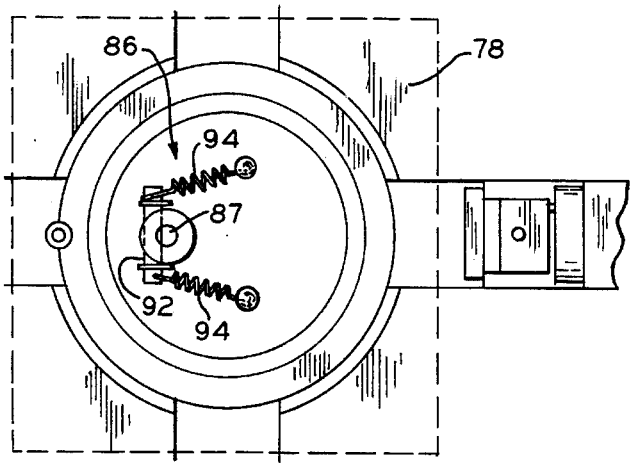
FIG. 6 is a sectional view of the weld head assembly, taken along line 6—6 in FIG. 5.

Referring now to FIGS. 4–6, weld head assembly 36 is shown in greater detail, when in engagement with canister 32. Weld head assembly 36 includes a fluid ram assembly 66, which may be either pneumatic or hydraulic and which has an output ram 68. Connected to ram 68 of fluid ram assembly 66 is a female housing 70, which in turn engages one end of a compression spring 72. Compression spring 72 is connected at the other end thereof to a male housing 74, which in turn is connected to a welding electrode 80. Also shown as being attached to female housing 70 is a linear variable displacement transducer (LVDT) 76, which will be described in further detail hereinafter.

Welding electrode 80 is slidably disposed within a bore 87 which passes through a weld head 78. A first seal 82 is operably associated with welding electrode 80, and a second seal 84 is adapted for engagement with and in operable association with canister 32 (FIG. 5).

Disposed at the bottom end of weld head 78 is a ball retention mechanism 86 which holds a weld ball within weld head 78 during a gas fill operation. Ball retention mechanism 86 (FIGS. 2 and 6) includes a projection 88 extending downwardly from weld head 78 and having a notch 90 form therein. Notch 90 receives a rod 92 therein which extends partly across bore 87 to maintain a weld ball 60 thereabove. A pair of springs 94 are attached at one end thereof to rod 92 and at another end thereof to weld head 78. Springs 94 thus bias rod 92 to the position shown in FIG. 6, whereby rod 92 extends partially into and across bore 87.

In operation, ball shuttle assembly 38 starts in the position shown in phantom lines in FIG. 2, wherein bore 56 of shuttle block 40 is disposed in coaxial alignment with gravity feed tube 62. A weld ball 60 thus drops into bore 56. Ball shuttle assembly 38 then moves to the position shown in solid lines in FIG. 2, wherein bore 56 is disposed in coaxial alignment with a longitudinal axis of bore 87 of weld head assembly 36. Rotary actuator 42 causes rotation of first shaft 44 and movement of rod 54 and weld ball 60 in an axial direction, whereby rod 54 and weld ball 60 are disposed within bore 87 of weld head assembly 36. More particularly, weld ball 60 is moved past ball retention mechanism 86 whereby weld ball 60 is disposed above rod 92. Ball retention mechanism 86 maintains weld ball 60 above rod 92 during the procedure of filling canister 32 with gas. Rod 54 is then moved in an axially downward direction by rotation of rotary actuator 42, such that rod 54 is not disposed within bore 87 and ball shuttle assembly 38 is moved to the position shown in phantom lines at a position remote from weld head assembly 36.

When a weld ball 60 is to be supplied to weld head assembly 36, welding electrode 80 is moved to a vertically upward position, whereby welding electrode 80 does not contact weld ball 60 (i.e., welding electrode 80 is spaced above ball retention mechanism 86). After a ball is supplied to weld head assembly 36, ball shuttle assembly 38 (including shuttle block 40) slides out of the way, and canister 32 is moved into engagement with weld head assembly 36, whereby an upper flange 96 of canister 32 is sealingly engaged with second seal 84 of weld head assembly 36. Thereafter, gas is supplied to canister 32, and welding electrode 80 is moved in a vertically downward direction such that weld ball 60 is stripped from ball retention mechanism 86 and drops into a gas fill opening 98 (FIG. 10) of canister 32. Welding electrode 80 continues to move downward and engages weld ball 60 disposed on top of and partly within gas fill opening 98. Fluid ram assembly 66 continues to drive output shaft 68, such that a pre-load exists on compression spring 72 (FIG. 5). Concurrently with exertion of the pre-load on compression spring 72, spring loaded piston 100 of LVDT 76 is brought into contact with a fixed surface (not shown). The fixed surface moves in correspondence with welding electrode 80. Depending upon the amount of compression of spring loaded piston 100, LVDT 76 provides a corresponding output signal to a processor 102 or the like. When an electrical current is applied to welding electrode 80 and weld ball 60 melts within gas fill opening 98 of canister 32, welding electrode 80 will move in a downward direction because of the downward force applied by compression spring 72. Correspondingly, the fixed surface against which spring loaded piston 100 is disposed moves downward, causing spring loaded piston 100 to in turn move downward. Because of the compression of spring loaded piston 100, a different output signal is supplied by LVDT 76 to processor 100, which indicates that welding has been completed. Welding electrode 80 is then moved to a vertically upward position, and canister 32 is moved in a vertically downward direction out of engagement with weld head assembly 36.

Referring now to FIGS. 7–10, proofing station 24 is shown in greater detail. In the embodiment of the system shown in FIG. 1, six such proofing stations 24 are utilized.

Proofing station 24 includes a frame 110 attached to a fluid actuated ram assembly 112. Ram assembly 12 includes a ram 114 extending into a cylinder 116. Cylinder 116 is adapted to hold either a gas or a liquid, i.e., ram assembly 112 can be either pneumatic or hydraulic.

Ram 114 is pivotably attached at a distal end thereof to links 116 at pins 117, which in turn are pivotably attached to jaws 118 at pins 119. Ram 114 includes a slot-shaped opening 123 which allows sliding as well as pivoting movement between ram 114 and link 116. Alternatively, either link 116 and/or jaw 118 may include an opening which is slot-shaped, thereby allowing sliding as well as pivoting movement between link 116 and jaw 118.

Jaws 118 are pivotably connected to frame 110 at pins 121, and further connected to fingers 120 such that a slight amount of relative movement may occur therebetween. More particularly, a stub shaft 122 is affixed to jaw 118 and extends through finger 120. A spacer 124 is interposed between jaw 118 and finger 120 and a nut 126 is only slightly tightened against finger 120. A further shaft 128 extends through finger 120 and is affixed to jaw 118. Rather than having a washer between finger 120 and jaw 118, a plurality of Bellville washers 130 are disposed in a stack arrangement and carried by shaft 128. Bellville washers 130 may be slightly compressed, and thus slight relative movement between finger 120 and jaw 118 is possible.

Frame 110 also includes a head 132 having a pin 134 and a stake 136 extending downwardly therefrom. Pin 134 and stake 136 are adapted to be received within corresponding openings formed in upper flange 96 of canister 32.

Figure 10:
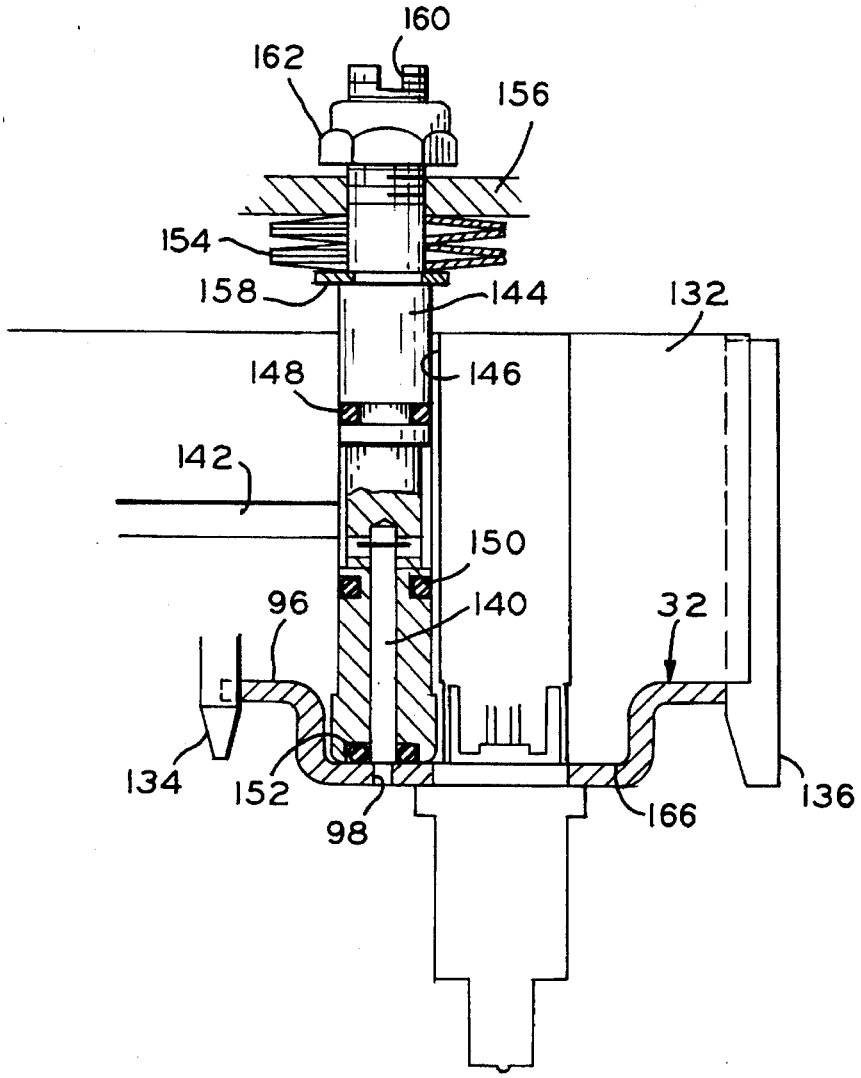
FIG. 10 is a side sectional view of the pressure test station shown in FIG. 7, showing the sealed head in contact with an air bag canister.

FIG. 10 illustrates head 132 in greater detail. A bore 140 is located to be in substantially coaxial alignment with gas fill opening 98 of canister 32 when head 132 is engaging canister 32. Bore 140 is disposed in fluid communication with a further passageway 142 which receives a source of pressurized fluid from an external source (not shown). As shown, bore 140 is formed within a cylindrical member 144. Cylindrical member 144 is slidably disposed within a corresponding opening 146 of head 132. Seals 148, 150 allow fluid communication between passageway 142 and bore 140, while preventing escape of gas to the outside ambient environment. A third seal 152 is carried on an end face of cylindrical member 144 and surrounds gas fill opening 98 when head 132 engages canister 32. A compression spring 154 is disposed at an end of cylindrical member 144 which is opposite from third seal 152 and between a fixed member 156 and a shoulder 158. A slot 160 formed in cylindrical member 144 and a nut 162 allow adjustment of the preload on spring 154.

Figure 7:
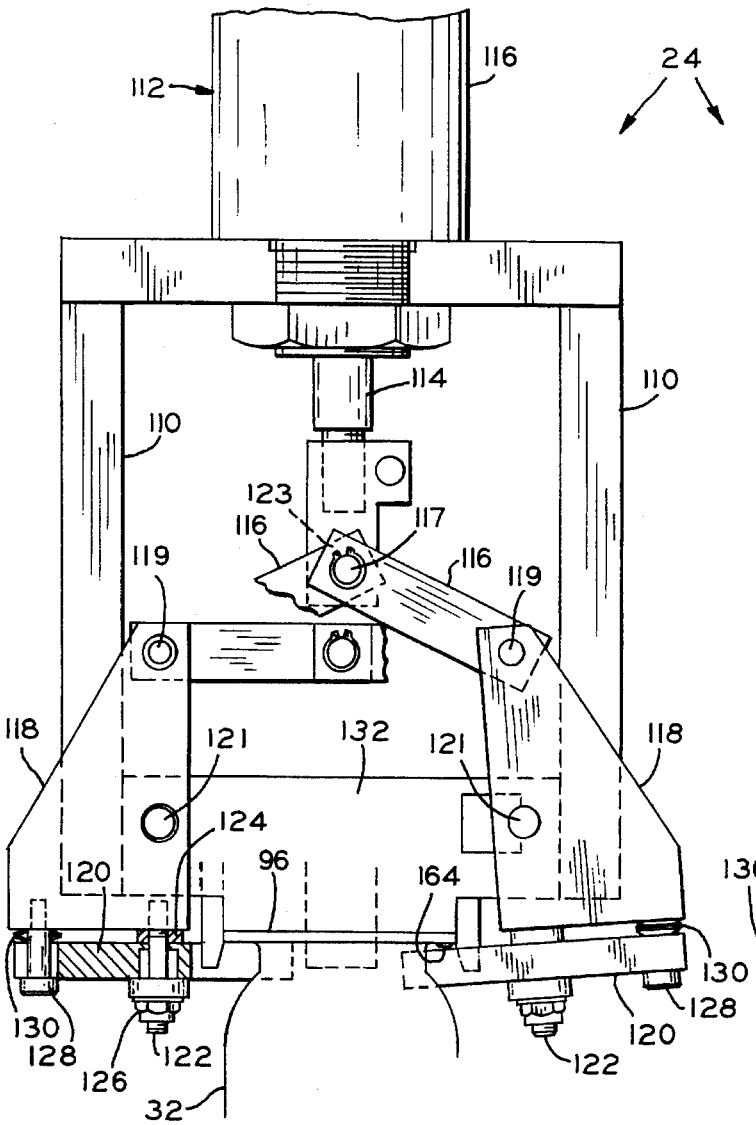
FIG. 7 is a front view of an embodiment of a pressure test station assembly of the present invention.
Figure 8:
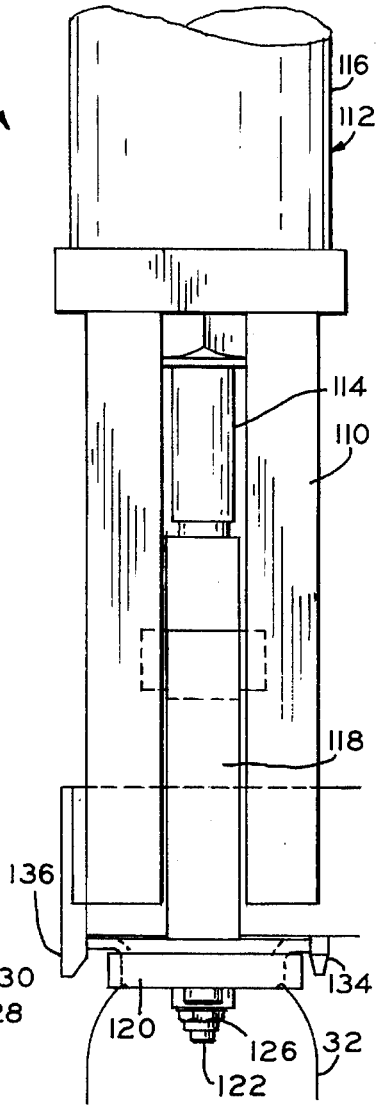
FIG. 8 is a side view of the pressure test station assembly shown in FIG. 7.
Figure 9:
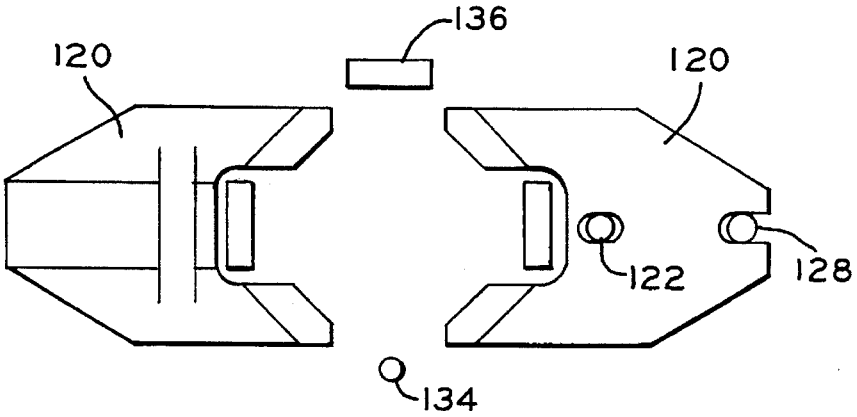
FIG. 9 is a bottom view of the pressure test station assembly shown in FIG. 7.

In operation, ram 114 is moved to a downward, extended position which in turn rotates jaws 118 and fingers 120 to the open position. A canister 32 is brought into contact with head 132 and aligned with pin 134 and stake 136. To accomplish such alignment, either canister 32 may be rotated or frame 110 may be rotated. With canister 32 in the aligned position, ram 114 is retracted which causes rotation of jaws 118 and moves fingers 120 underneath of upper flange 96 of canister 32. Because of manufacturing defects and/or weld spatter which may exist as a result of earlier welding to canister 32, upper flange 96 may not be oriented correctly relative to head 132. That is, upper flange 96 may not be parallel with and end face of head 132, which in turn results in inadequate sealing therebetween utilizing third seal 152. To properly test canister 32 for leaks, etc., a high pressure gas is introduced to the interior of canister 32 and maintained therein for a predetermined amount of time. If a proper sealing does not exist between canister 32 and head 132, the pressure testing will indicate that a leakage path exists within canister 32, when in fact no such leakage path may be present. The present invention ensures that upper flange 96 is correctly oriented relative to head 132 to prevent such a problem. To wit, as ram 114 is retracted, finger 120 may engage weld spatter 164 as indicated in FIG. 7. The slot formed in link 116 and/or jaw 118, as well as bellville washer 130 allow one jaw 118 and finger 120 to be disposed at a different angle with respect to shaft 114 then the other jaw 118 and finger 120. The present invention therefore allows upper flange 96 to be drawn flat against end face 166 of head 132 to ensure proper sealing engagement therebetween. After the pressure test takes place by transmitting the high pressure gas through passageway 142, bore 140 and gas fill opening 98 into canister 32 for a predetermined amount of time, ram 114 is again moved to the extended position which disengages jaws 118 and fingers 120 from canister 32, such that canister 32 may be removed therefrom.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for filling a canister with pressurized fluid and sealing the said filled canister, the canister having a weldable end wall with an opening therein for receiving a weld ball, said apparatus comprising:

a weld head assembly including a head having an opening for receiving a pressurized gas, said opening defining a terminal end, said head further having a seal operably associated with said terminal end for engaging the said end wall of the said canister, said weld head assembly further including a welding electrode; and a ball shuttle assembly including a shuttle block, said shuttle block having a passage for receiving the said weld ball and means for receiving the weld ball from said passage means and holding the said weld ball, said ball shuttle assembly further including positioning means for positioning said shuttle block whereby the said weld ball is in substantially coaxial alignment with said opening, and moving means for moving said receiving and holding means whereby the weld ball is disposed in said opening;

said passage being fluidly disassociated from said opening when said seal is engaged with the said end wall of the said canister.

2. The apparatus of claim 1, wherein said receiving and holding means comprises a substantially vertical passage, a rod reciprocably disposed within said passage and means engaging said rod for reciprocating said rod within said vertical passage.

3. The apparatus of claim 2, wherein said reciprocating means comprises a cam member.

4. The apparatus of claim 3, further comprising a rotary actuator connected to said cam member for rotating said cam member, and thereby effecting said reciprocating movement of said rod within said vertical passage.

5. The apparatus of claim 1, further comprising means for maintaining the weld ball within said elongated opening.

6. The apparatus of claim 5, wherein said maintaining means comprises a catch member extending partially into said opening and means for biasing said catch member into said opening.

7. The apparatus of claim 6, wherein said biasing means comprises at least one spring interconnecting said catch member and said head portion.

8. The apparatus of claim 6, wherein said catch member comprises a rod disposed transverse to and partly across said opening.

9. The apparatus of claim 5, wherein said elongated opening is disposed substantially vertically and said welding electrode includes a lower end, and further comprising means for moving said welding electrode between a first position wherein said welding electrode lower end is disposed above said maintaining means, and a second position wherein said welding electrode lower end is disposed below said maintaining means.

10. The apparatus of claim 1, further comprising means for moving said welding electrode between a first, upward position and a second, downward position.

11. The apparatus of claim 10, wherein said welding electrode moving means comprises a fluid actuated ram assembly having a ram which is one of directly and indirectly connected to said welding electrode and exerts a force against said welding electrode.

12. The apparatus of claim 11, further comprising a compression spring interposed between said ram and said welding electrode.

13. The apparatus of claim 11, wherein the said weld ball is disposed in the said weldable end wall opening when said welding electrode is in the second, downward position, and further comprising means for applying an electric current to said welding electrode and thereby melting the said weld ball in the said weldable end wall opening.

14. The apparatus of claim 13, further comprising means for sensing said melting of the said weld ball in the weldable end wall opening.

15. The apparatus of claim 14, wherein said sensing means comprises a linear variable displacement transducer providing a first signal when said welding electrode contacts the said weld ball prior to melting of the said weld ball, and a second signal after melting of the said weld ball.

16. The apparatus of claim 15, wherein said sensing means senses movement of said welding electrode.

17. An apparatus for filling a canister with pressurized fluid and sealing the said canister with the pressurized fluid therein, the said canister having a weldable end wall with an opening therein for receiving a weld ball, said apparatus comprising:

a weld head assembly including a head having an opening for receiving a pressurized gas, said opening defining a terminal end, said head further having a seal operably associated with said terminal end for engaging the said end wall of the said canister, said weld head assembly further including a welding electrode; and a ball shuttle assembly including a shuttle block, said shuttle block having a passage for receiving the said weld ball and means for receiving the weld ball from said passage means and holding the said weld ball, said shuttle block movable between a first position wherein a portion of said shuttle block is disposed in alignment with said head opening, and a second position wherein no portion of said shuttle block is disposed in alignment with said head opening.

18. The apparatus of claim 17, wherein said receiving and holding means is in substantially coaxial alignment with said head elongated opening when said shuttle block is moved to said first position.

19. The apparatus of claim 17, wherein said passage means of said ball shuttle assembly is fluidly disassociated from said opening of said weld head assembly when said seal is engaged with the end wall of the canister.

20. An apparatus for pressure testing a canister with pressurized fluid, the canister having a weldable end wall with a lip and an opening therein, said apparatus comprising:

a head portion having an end face and an opening for receiving a pressurized gas, said opening defining a terminal end, said end face having a seal operably associated with said terminal end, said seal defining an end face for engaging one of the end wall and the lip of the said canister;

at least two arms, each said arm including a shoulder for engaging the canister lip and pulling one of the end wall and the lip against said seal end face, each said arm being separately and pivotably connected to said head portion whereby said shoulders are independently pivotable relative to one another, and thereby allow at least one of the end wall and the lip to be disposed parallel to said end face.

* * * * *